US005227854A

United States Patent [19]

Dastin et al.

[11] Patent Number: 5,227,854

[45] Date of Patent: Jul. 13, 1993

[54] SHEET TRANSPORT SYSTEM WITH SHEET VELOCITY MANIPULATION

[75] Inventors: Richard M. Dastin, Fairport; Kenneth J. Mihalyov; Kenneth G. Christy, both of Webster, all of N.Y.

[73] Assignee: Xerox Corporation, Stamford, Conn.

[21] Appl. No.: 754,832

[22] Filed: Sep. 4, 1991

[51] Int. Cl.[5] ..... G03G 21/00

[52] U.S. Cl. ..... 355/317; 271/202; 271/204; 271/270; 271/277; 355/275; 355/326

[58] Field of Search ..... 346/160, 157; 271/270, 271/277, 202, 204; 355/275, 317, 326, 327, 328, 274

[56] References Cited

U.S. PATENT DOCUMENTS

| | | | |
|---|---|---|---|
| 2,571,806 | 10/1951 | Wood | 271/270 |
| 4,849,795 | 7/1989 | Spehrley, Jr. et al. | 355/317 |
| 4,891,674 | 1/1990 | Seyfried | 355/245 |
| 5,075,734 | 12/1991 | Durland et al. | 355/326 X |
| 5,138,399 | 8/1992 | Castelli et al. | 355/327 |

*Primary Examiner*—A. T. Grimley
*Assistant Examiner*—J. E. Barlow, Jr.
*Attorney, Agent, or Firm*—Kenyon & Kenyon

[57] ABSTRACT

A method and apparatus for manipulating the velocity of a copy sheet in a color reprographic system creates a buckle in the copy sheet to decouple accelerations of the leading edge of the copy sheet from the portion that is in contact with the photoreceptor belt and reduces the buckle on long copy sheets for which the buckle can become large enough that the toner image on the body of the copy sheet can become disrupted by contact with stationary portions of the system. The method and apparatus also accelerates the leading edge of the copy sheet as the trailing edge disengages from the photoreceptor belt to prevent the uncontrolled trailing edge of lightweight copy sheets from contacting stationary portions of the system.

9 Claims, 8 Drawing Sheets

SHEET TRANSPORT SYSTEM WITH SHEET VELOCITY MANIPULATION

BACKGROUND OF THE INVENTION

The invention relates generally to a color electronic reprographic printing system, and more particularly concerns a method and apparatus for controlling the movement of a sheet to which is applied a plurality of developed images transferred thereto and the movement of a sheet gripper to prevent the image-bearing surface of the sheet from touching stationary surfaces in the printing system while the sheet is moving in a recirculating path.

The marking engine of an electronic reprographic printing system is frequently an electrophotographic printing machine. In an electrophotographic printing machine, a photoconductive member is charged to a substantially uniform potential to sensitize the surface thereof. The charged portion of the photoconductive member is thereafter selectively exposed. Exposure of the charged photoconductive member dissipates the charge thereon in the irradiated areas. This records an electrostatic latent image on the photoconductive member corresponding to the informational areas contained within the original document being reproduced. After the electrostatic latent image is recorded on the photoconductive member, the latent image on the photoconductive member which is subsequently transferred to a copy sheet. The copy sheet is heated to permanently affix the toner image thereto in image configuration.

Multi-color electrophotographic printing is substantially identical to the foregoing process of black and white printing. However, rather than forming a single latent image on the photoconductive surface, successive latent images corresponding to different colors are recorded thereon. Each single color electrostatic latent image is developed with toner of a color complementary thereto. This process is repeated a plurality of cycles for differently colored images and their respective complementarily colored toner. Each single color toner image is transferred to the copy sheet in superimposed registration with the prior toner image. This creates a multi-layered toner image on the copy sheet. Thereafter, the multi-layered toner image is permanently affixed to the copy sheet creating a color copy. The developer material may be a liquid or a powder material.

In the process of black and white printing, the copy sheet is advanced from an input tray to a path internal the electrophotographic printing machine where a toner image is transferred thereto and then to an output catch tray for subsequent removal therefrom by the machine operator. In the process of multi-color printing, the copy sheet moves from an input tray through a recirculating path internal to the printing machine where a plurality of toner images is transferred thereto and then to an output catch tray for subsequent removal. With regard to multi-color printing, a sheet gripper secured to a transport receives the copy sheet and transports it in a recirculating path enabling the plurality of different color images to be transferred thereto. The sheet gripper grips one edge of the copy sheet and moves the sheet in a recirculating path so that accurate multi-pass color registration is achieved. In this way, magenta, cyan, yellow, and black toner images are transferred to the copy sheet in registration with one another.

Some systems for transporting a copy sheet into registration with a toner image developed on a moving member accelerate the copy sheet during transfer of the toner image from the moving member to the copy sheet. Such acceleration may occur when the leading portion of the sheet is being negotiated through a nonlinear path while at the same time the trailing portion of the copy sheet is traveling through the transfer zone. An example of the above deterioration is a blurred or smeared image produced on the copy sheet.

One solution to this problem is to decouple the acceleration of the leading portion of the copy sheet while any portion of the sheet is in the transfer zone. This is done by forming a buckle in a leading portion of the sheet in a region immediately ahead of the transfer zone. Any acceleration of the leading edge of the sheet will simply decrease the size of the buckle, thus preventing the acceleration from being transmitted to the trailing portion of the sheet remaining in the transfer zone.

The buckle can be formed by advancing the leading edge of the copy sheet at a slightly lower velocity than the portion of the copy sheet in the transfer zone. For standard size sheets, such as an 8½" by 11" sheet, the size of the buckle can be accommodated within a relatively narrow gap through which the sheet passes. This gap can be bounded by stationary surfaces that serve to control the sheet's movement by guiding its trailing edge. The surface of the sheet on which unfused toner is carried thus is not disrupted by contact with the stationary surfaces.

However, when the copy sheet is long, such as with an 11" by 17" sheet fed with the 11" edge leading, the same velocity differential between the sheet leading edge and the portion of the sheet in the transfer zone used for smaller sheets produces a correspondingly larger buckle. This larger buckle can cause the body portion of the sheet to contact the stationary surfaces, disrupting the unfused toner image. It is impractical to enlarge the system to allow more room for the larger buckle to clear the stationary portions—the system is volume-limited, and the placement of the stationary surfaces is critical to trailing-edge control. There is therefore a need to isolate leading edge accelerations from the portion of the sheet in the transfer zone while eliminating excessive sheet buckle on long sheets.

Circulation of lightweight sheet stock through a color reprographic system as described also presents problems of contact of the unfused toner image on the body portion of the copy sheet with stationary surfaces. Lightweight, flexible sheets, such as those of less than 15 pounds weight, are susceptible to relatively large displacements from a desired path when the rear portion of the sheet is not controlled, such as when the trailing edge of the sheet leaves the transfer zone. This is because the relatively low beam stiffness of such lightweight sheets is insufficient to resist the forces imposed by electrostatic attraction of the charged sheet to stationary objects and by random air currents within the reprographic system. There is therefore a need to control the movement of such lightweight copy sheets when the rear portion of the sheet is not controlled.

SUMMARY OF THE INVENTION

These problems are overcome, and these needs are met, by the method and apparatus of the invention. In accordance with one embodiment of the apparatus of the invention, an apparatus advances a sheet through a transfer zone and into registration with information developed on a moving member. The apparatus comprises means for advancing the sheet through the transfer zone, means, acting in unison with the advancing means, for creating a buckle in a portion of the sheet in a region immediately ahead of the transfer zone relative to the direction of movement of the moving member, and means for selectively reducing the buckle. In accordance with a first embodiment of the method of the invention, the sheet is advanced through the transfer zone, a buckle is formed in the sheet, and the buckle is reduced while a trailing portion of the sheet is in the transfer zone.

In accordance with a second embodiment of the apparatus of the invention, means is provided for advancing the leading edge of the sheet at a first velocity, along with means for advancing a body portion of the sheet in contact with the moving member at a second velocity greater than the first velocity, and means for accelerating the leading edge of the sheet as the trailing edge of the sheet disengages from the moving member. In accordance with a second embodiment of the method of the invention, the leading edge of the sheet is advanced at a first velocity, the body portion of the sheet is advanced in contact with the moving member at a second velocity greater than the first velocity, and the leading edge of the sheet is accelerated as the trailing edge of the sheet disengages from the moving member.

The invention has the advantages that it minimizes the space necessary to enable the circulation of long and lightweight copy sheets while preventing disruption of the unfused toner and that it does so without requiring additional hardware.

DETAILED DESCRIPTION

Figure 1:
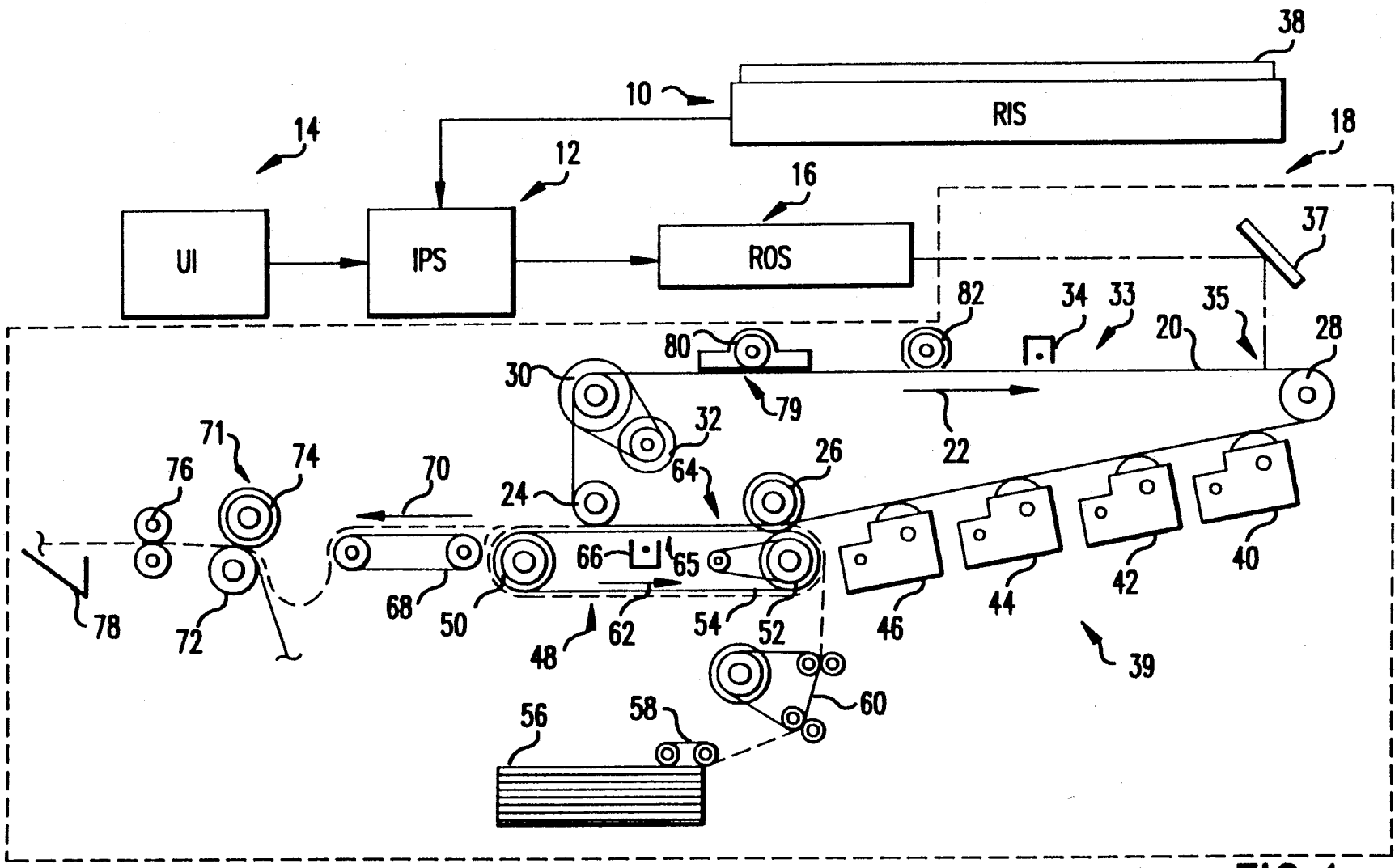
FIG. 1 is a schematic elevational view illustrating an electrophotographic printing machine incorporating the features of the present invention therein.

For a general understanding of the features of the present invention, reference is made to the drawings. In the drawings, like references have been used throughout to designate identical elements. FIG. 1 is a schematic elevational view of an illustrative electrophotographic machine incorporating the features of the present invention therein. It will become evident from the following discussion that the present invention is equally well suited for use in a wide variety of printing systems, and is not necessarily limited in its application to the particular system shown herein.

Turning initially to FIG. 1, during operation of the printing system, a multi-color original document 38 is positioned on a raster input scanner (RIS), indicated generally by the reference numeral 10. The RIS contains document illumination lamps, optics, a mechanical scanning drive, and a charge coupled device (CCD) array. The RIS captures the entire original document and converts it to a series of raster scan lines and measures a set of primary color densities, i.e. red, green, and blue densities, at each point of the original document. This information is transmitted to an image processing system (IPS), indicated generally by the reference numeral 12. IPS 12 contains control electronics that prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The output signal from UI 14 is transmitted to IPS 12. A signal corresponding to the desired image is transmitted from IPS 12 to ROS 16, which creates the output copy image. ROS 16 lays out the image in a series of horizontal scan lines with each line having a specified number of pixels per inch. ROS 16 includes a laser and an associated rotating polygon mirror block. ROS 16 exposes a charged photoconductive belt 20 of a printer or marking engine, indicated generally by the reference numeral 18, to achieve a set of subtractive primary latent images. The latent images are developed with cyan, magenta, and yellow developer material, respectively. These developed images are transferred to a copy sheet in superimposed registration with one another to form a multi-colored image on the copy sheet. This multi-colored image is then fused to the copy sheet forming a color copy.

With continued reference to FIG. 1, printer or marking engine 18 is an electrophotographic printing machine. Photoconductive belt 20 of marking engine 18 is preferably made from a polychromatic photoconductive material. The photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform electrostatic potential.

Next, the charged photoconductive surface is rotated to an exposure station, indicated generally by the reference numeral 35. Exposure station 35 receives a modulated light beam corresponding to information derived by RIS 10 having a multi-colored original document 38 positioned thereat. RIS 10 captures the entire image from the original document 38 and converts it to a series of raster scan lines, which are transmitted as electrical signals to IPS 12. The electrical signals from RIS 10 correspond to the red, green, and blue densities at each point in the original document. IPS 12 converts the set of red, green, and blue density signals, i.e., the set of signals corresponding to the primary color densities of original document 38, to a set of colorimetric coordinates. The operator actuates the appropriate keys of UI 14 to adjust the parameters of the copy. UI 14 may be a touch screen, or any other suitable control panel, providing an operator interface with the system. The output signals from UI 14 are transmitted to IPS 12. The IPS then transmits signals corresponding to the desired image to ROS 16. ROS 16 includes a laser with rotating polygon mirror blocks. Preferably, a nine facet polygon is used. ROS 16 illuminates, via mirror 37, the charged portion of photoconductive belt 20 at a rate of about 400 pixels per inch. The ROS will expose the photoconductive belt to record three latent images. One latent image is adapted to be developed with cyan developer material. Another latent image is adapted to be developed with magenta developer material and the third latent image is adapted to be developed with yellow developer material. The latent images formed by ROS 16 on the photoconductive belt correspond to the signals transmitted from IPS 12.

After the electrostatic latent images have been recorded on photoconductive belt 20, the belt advances such latent images to a development station, indicated generally by the reference numeral 39. The development station includes four individual developer units indicated by reference numerals 40, 42, 44, and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white origninal document. Each of the developer units is moved into and out of an operative position. In the operative position, the magnetic brush is closely adjacent the photoconductive belt, while in the non-operative position, the magnetic brush is spaced therefrom. In FIG. 1, developer unit 40 is shown in the operative position with developer units 42, 44, and 46 being in the non-operative position. During development of each electrostatic latent image, only one developer unit is in the operative position, the remaining developer units are in the non-operative position. This ensures that each electrostatic latent image is developed with toner particles of the appropriate color without commingling.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper or transparent plastic. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper, generally indicated by the reference numeral 84 (see FIGS. 2–7), extends between belts 54 and moves in unison therewith. A sheet 25 is advanced from a stack of sheets 56 disposed on a tray. A friction retard feeder 58 advances the uppermost sheet from stack 56 onto a pre-transfer transport 60. Transport 60 advances sheet 25 to sheet transport 48. Sheet 25 is advanced by transport 60 in synchronism with the movement of sheet gripper 84. In this way, the leading edge of sheet 25 arrives at a preselected position, i.e. a loading zone, to be received by the open sheet gripper. The sheet gripper then closes securing sheet 25 thereto for movement therewith in a recirculating path. The leading edge of sheet 25 is secured releasably by the sheet gripper. Further details of the sheet transport apparatus will be discussed hereinafter with reference to FIGS. 2–7. As belts 54 move in the direction of arrow 62, the sheet moves into contact with the photoconductive belt, in synchronism with the toner image developed thereon. At transfer zone 64, a corona generating device 66 sprays ions onto the backside of the sheet so as to charge the sheet to the proper electrostatic voltage magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another. One skilled in the art will appreciate that the sheet may move in a recirculating path for four cycles when under color black removal is used and up to eight cycles when the information on two original documents latent images recorded on the photoconductive surface is developed with the appropriately colored toner and transferred, in superimposed registration with one another, to the sheet to form the multi-color copy of the colored original document.

After the last transfer operation, the sheet gripper opens and releases the sheet. A conveyor 68 transports the sheet, in the direction of arrow 70, to a fusing station, indicated generally by the reference numeral 71, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to catch tray 78 for subsequent removal therefrom by the machine operator.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

Referring now to FIGS. 2–7, sheet gripper 84 is suspended between two spaced apart timing belts 54 mounted on rollers 50 and 52. Timing belts 54 define a continuous path of movement of sheet gripper 84. A servo motor 86 is coupled to roller 52 by a drive belt 88. Sheet gripper 84 includes a pair of guide members 85. A pair of spaced apart and continuous tracks 55 are respectively positioned substantially adjacent belts 54. Tracks 55 are respectively positioned substantially adjacent belts 54. Tracks 55 are respectively defined by a pair of track supports 57. Guide members 85 are slidably positioned within a respective track 55 (see FIGS. 5 and 6). Sheet gripper 84 further includes an upper-sheet gripping portion 87 and a lower sheet gripping portion 89 which are spring biased toward each other. The sheet gripper includes a pair of cams (not shown), which function to open and close the gripping portions at predetermined intervals. In the closed position, gripping portion 87 cooperates with gripping portion 89 to grasp and securely hold the leading edge of sheet 25. The area at which the gripping portions 87 and 89 grasp sheet 25 defines a gripping nip, generally indicated by the reference numeral 91 (see FIGS. 5 and 7). A silicone rubber coating (not shown) may be positioned upon lower sheet gripping portion 89, near gripping nip 91, to increase the frictional grip of sheet 25 between the gripping portions. Belts 54 are respectively connected to the opposed side marginal regions of sheet gripper 84 by a pair of pins 83. The belts are connected to the sheet gripper behind the leading edge of sheet 25 relative to the forward direction of movement of belts 54, as indicated by arrow 62, when sheet 25 is being transported by sheet transport 48. The sheet gripper is driven by the belts at the locations where the sheet gripper and the belts are connected. In the above configuration, the distance between the leading edge of the sheet and the location at which the sheet gripper is connected to the belts is approximately equal to or greater than one half of the length of the radius of roller 50.

In operation, belts 54 drive sheet gripper 84 at a constant velocity through transfer zone 64. However, when the sheet gripper is being negotiated through a non-linear portion of its path, the sheet gripper may accelerate. The sheet transport system of the present invention provides for decoupling of the acceleration of the sheet gripper from any portion of the sheet in the transfer zone. This is important in order to prevent slip between the copy sheet and the photoconductive belt in the transfer zone and thus provide for accurate transfer of the developed toner image from the photoconductive belt to the copy sheet thereby preserving the integrity of the image produced on the copy sheet.

Figure 2:
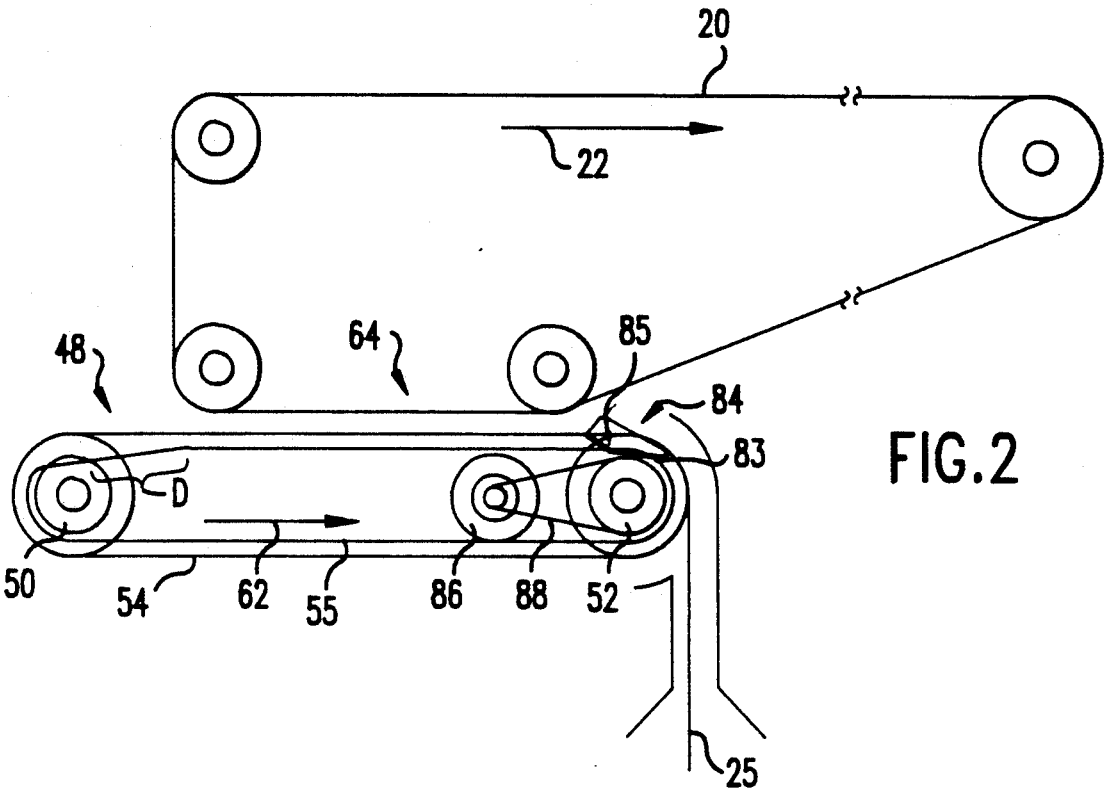
FIG. 2 is a schematic elevational view showing further details of the sheet transport system used in the electrophotographic printing machine of FIG. 1 and also showing the sheet gripper of the sheet transport system at a position prior to entering the transfer zone.
Figure 3:
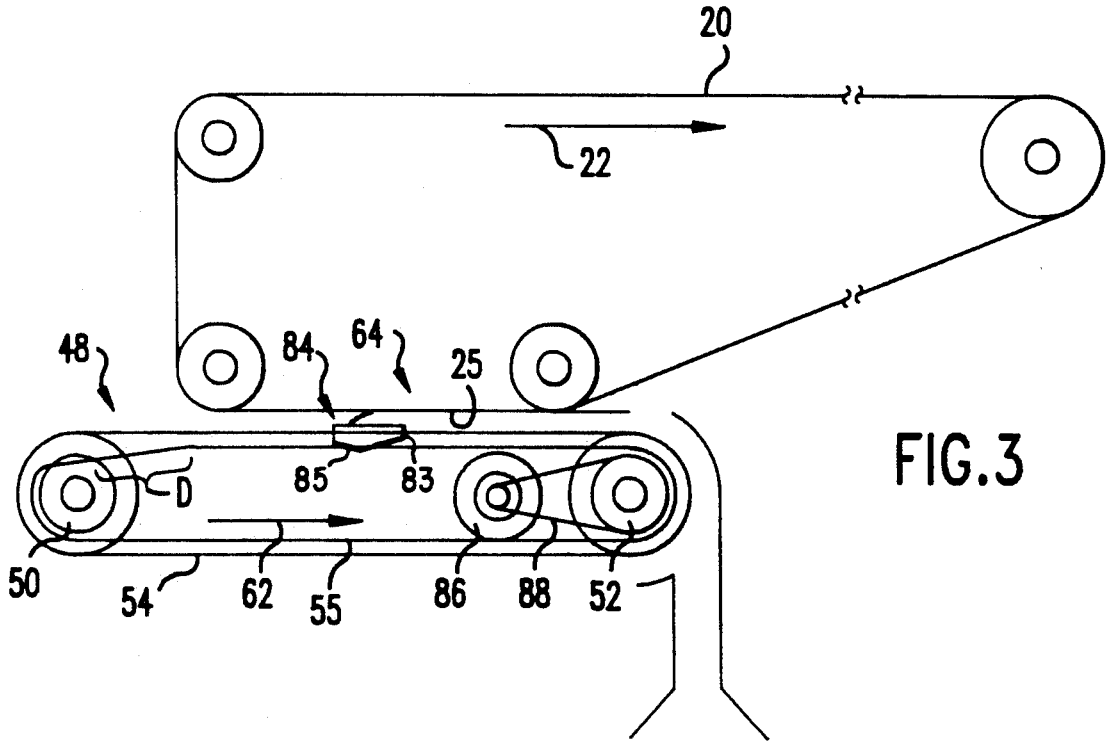
FIG. 3 is a schematic elevational view showing further details of the sheet transport system used in the electrophotographic printing machine of FIG. 1 and also showing the sheet gripper of the sheet transport system at a position within the transfer zone.
Figure 4:
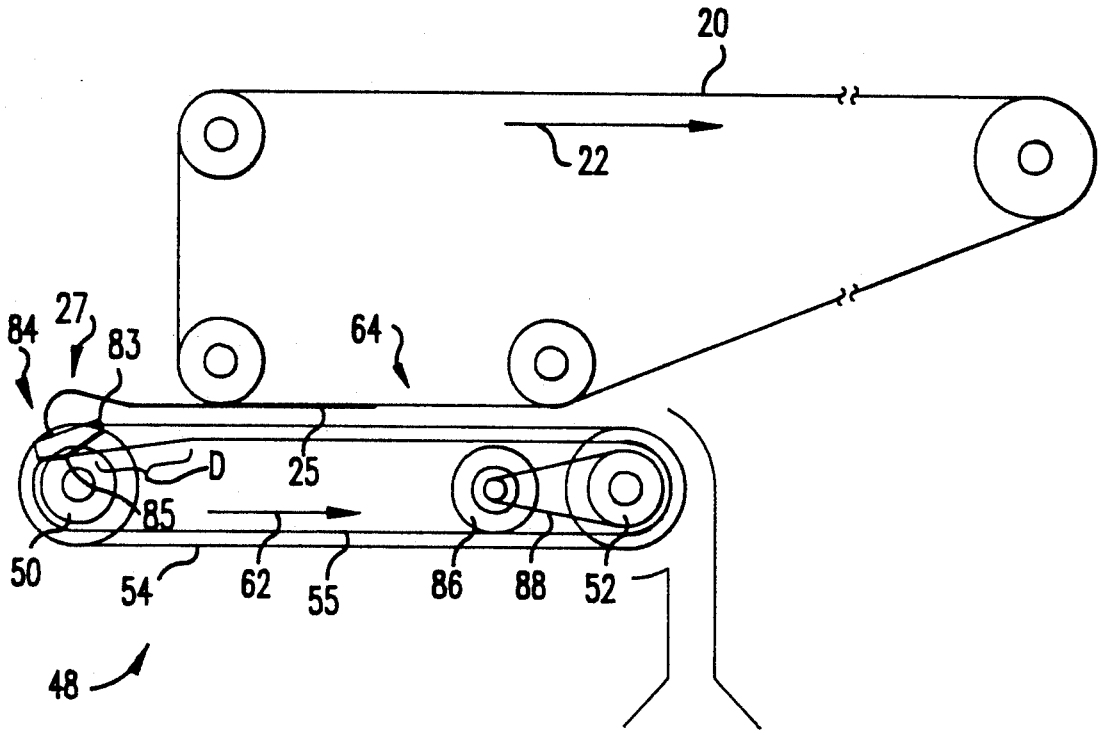
FIG. 4 is a schematic elevational view showing further details of the sheet transport system used in the electrophotographic printing machine of FIG. 1 and also showing the sheet gripper of the sheet transport system at a position after exiting the transfer zone.
Figure 5:
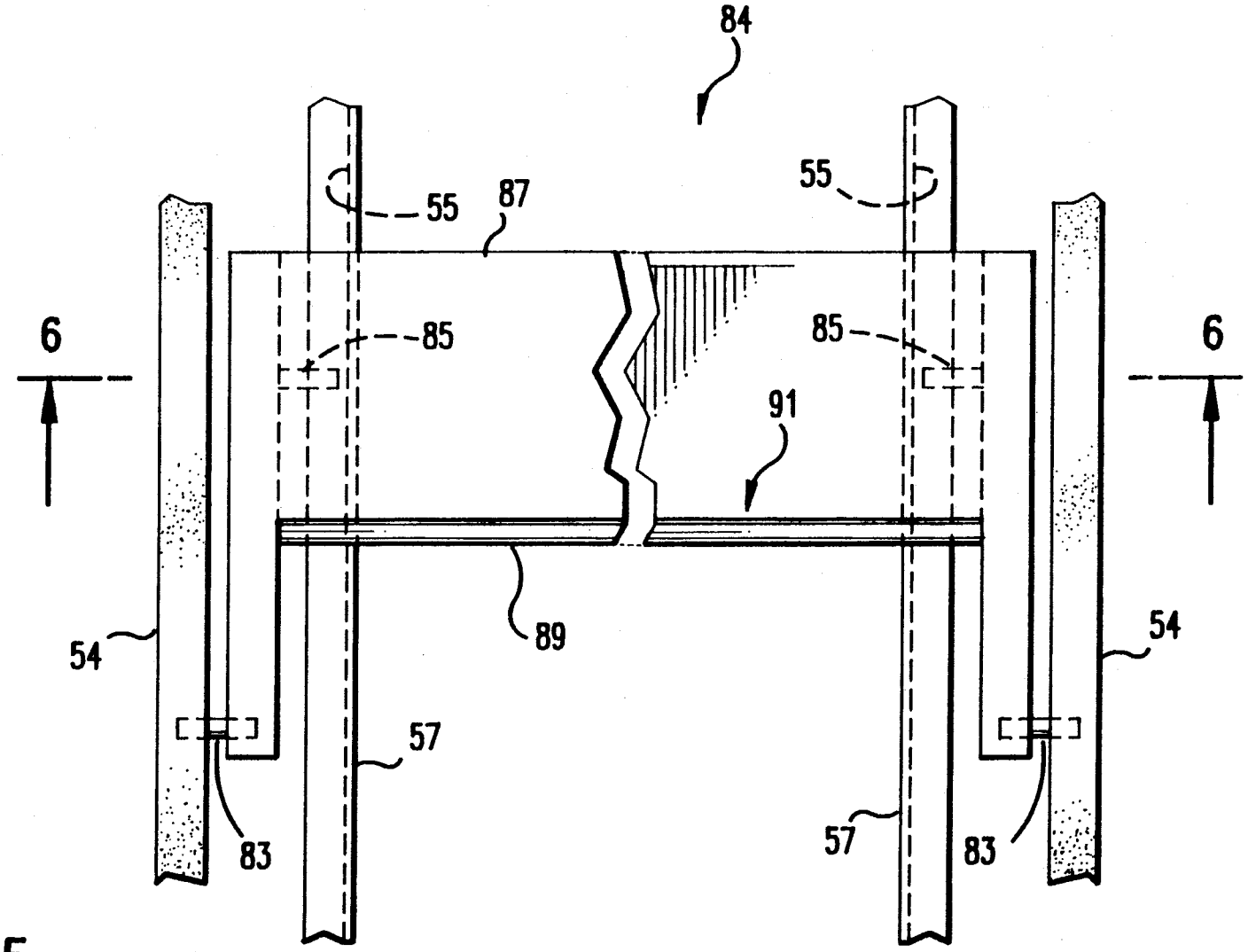
FIG. 5 is a schematic planar view showing the sheet gripper of the sheet transport system used in the electrophotographic printing machine of FIG. 1.
Figure 6:
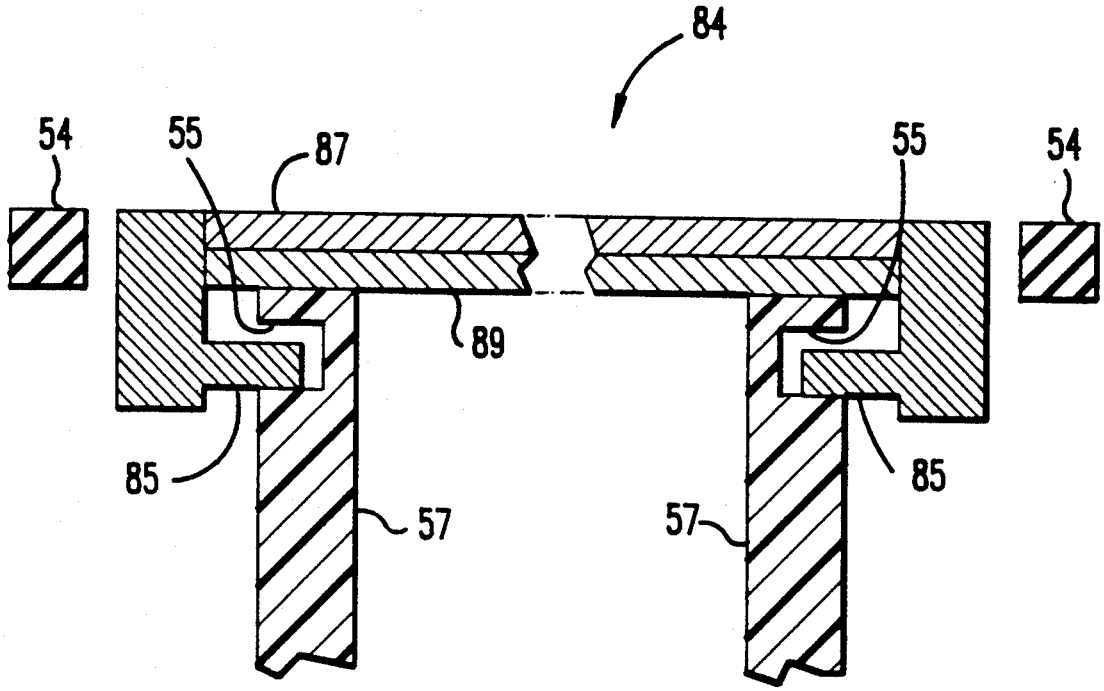
FIG. 6 is a sectional elevational view taken in the direction of arrows 6—6 in FIG. 5.
Figure 7:
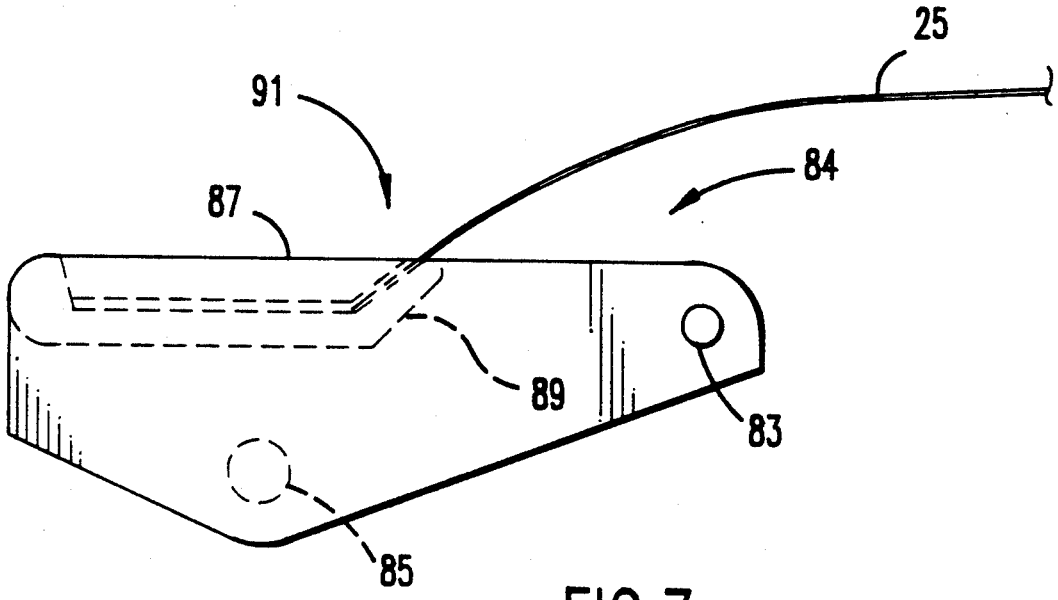
FIG. 7 is a schematic elevational view showing the sheet gripper of the sheet transport system used in the electrophotographic printing machine of FIG. 1.

FIGS. 2–4 depict the movement of sheet gripper 84 from a position before transfer zone 64 to a position after transfer zone 64 relative to the forward direction of movement of belts 54. As the sheet enters the gap between photoconductive belt 20 and the continuous path defined by the movement of sheet gripper 84, the sheet adheres to photoconductive belt 20 as a result of electrostatic forces imparted to the sheet by a corotron (not shown). The sheet travels in this manner through the transfer zone. FIG. 2 shows sheet gripper 84 gripping sheet 25 at about its leading edge prior to entering transfer zone 64. FIG. 3 shows sheet gripper 84 and a leading portion of sheet 25 advanced to a position within transfer zone 64. FIG. 4 shows sheet gripper 84 and the leading portion of sheet 25 at a position immediately ahead of transfer zone 64 relative to the forward direction of movement of belts 54 or photoconductive belt 20, as indicated by arrows 62 and 22 respectively, while a trailing portion of sheet 25 is within transfer zone 64. As shown in FIG. 4, a buckle (indicated generally by reference numeral 27) is formed in a portion of sheet 25 in a region immediately ahead of the transfer zone relative to the forward direction of movement of belts 54 or photoconductive belt 20. Buckle 27 functions to eliminate relative velocity between photoconductive belt 20 and any portion of sheet 25 within the transfer zone so as to substantially eliminate slip between the sheet and the photoconductive belt. This is true since an acceleration of the sheet gripper will merely decrease the size of buckle 27 and not transmit the acceleration back to the trailing portion of the sheet remaining in the transfer zone (see FIG. 4).

Buckle 27 is formed when the sheet gripper 84 and a leading portion of sheet 25 is advanced to a position immediately ahead of transfer zone 64 relative to the forward direction of movement of belts 54 or photoconductive belt 20 while a trailing portion of sheet 25 is within transfer zone 64 and the trailing portion of sheet 25 is caused to travel at a first velocity (which is determined by the velocity of the photoconductive belt) and the leading edge of sheet 25 is caused to travel at a second velocity (which is determined by the velocity of gripping nip 91), which is less than the first velocity. The velocity of gripping nip 91 in the region immediately ahead of the transfer zone relative to the forward direction of movement of the photoconductive belt is less than the velocity of the trailing portion of the sheet in the transfer zone (which is determined by the photoconductive belt) due to the orientation of tracks 55 in which guide members 85 of sheet gripper 84 slidably ride. More specifically, the velocity of guide members 85 (and consequently gripping nip 91) decrease relative to the velocity of belts 54 (and photoconductive belt 20) once the sheet gripper begins to travel through a portion of tracks 55 which deviate from a parallel orientation relative to belts 54. Such a portion of tracks 55 is indicated in FIGS. 2–4 by reference letter D. Thus, when a deviation in a portion of the tracks, as described above, is positioned in a region immediately ahead of the transfer zone relative to the forward direction of movement of the photoconductive belt, a buckle forms in the portion of the sheet in the aforementioned region as the sheet is transported by the sheet gripper through that region (see FIGS. 2–4). Alternatively, or in addition, the buckle can be formed by causing the servo motor 86 to drive the timing belts 54 at a slightly lower linear velocity than that of the photoreceptor, for example at a velocity differential of 0.2% to 0.3%.

Figure 8:
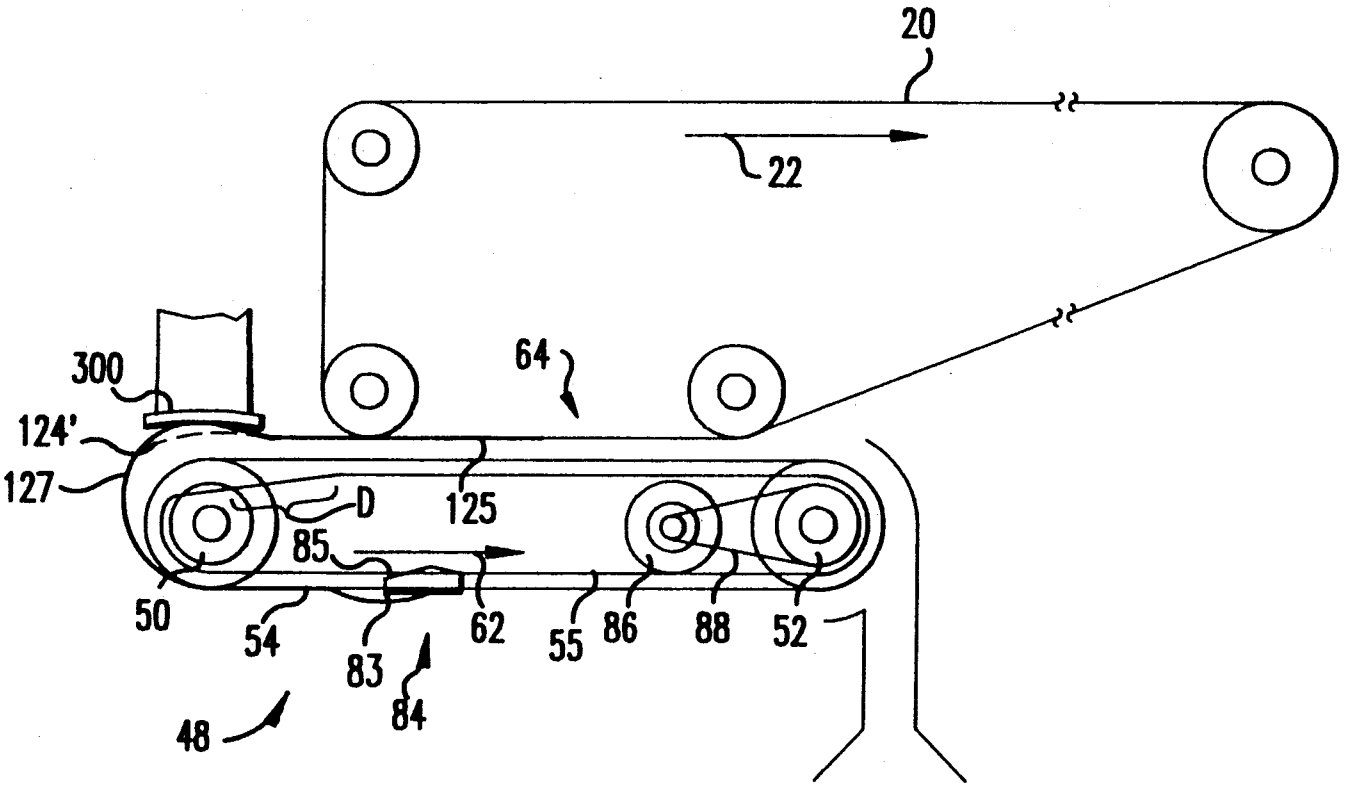
FIG. 8 is a schematic elevational view showing further details of the sheet transport system used in the electrophotographic printing machine of FIG. 1 and also showing the sheet gripper of the sheet transport system at a position where a long copy sheet touches the paper guide.

Again, as stated above, the buckle functions to eliminate relative velocity between the photoconductive belt and any portion of the sheet within the transfer zone so as to substantially eliminate slip between the sheet and the photoconductive belt thereby maintaining the integrity of the imaged transferred to the copy sheet. However, when long sheets are used, the buckle can grow too large and can cause the body portion of the sheet to contact stationary surfaces. This problem is illustrated in FIG. 8. Long sheet 125 remains in the transfer zone 64, and thus in contact with the photoreceptor belt 20, longer than a short sheet 25. The buckle 127 is therefore correspondingly larger than buckle 27 illustrated in FIG. 4. As a result, the body portion of the sheet bearing the unfused toner can contact a stationary surface, such as cleaner guide 300, disrupting the unfused toner.

This problem is solved in accordance with the present invention by creating a "hitch" in the velocity of the sheet gripper 84, accelerating the sheet gripper to a higher velocity to pull out some of the buckle in the copy sheet. This produces the reduced buckle 127'' shown in FIG. 8. After a desired amount of the buckle has been pulled out, the sheet gripper is returned to its usual velocity. Finally, before the sheet gripper next enters the transfer zone, it is decelerated to a lower velocity for a time sufficient to place the copy sheet into correct registration with the next image on the photoreceptor belt, and the sheet gripper is again returned to its usual velocity.

Figure 9:
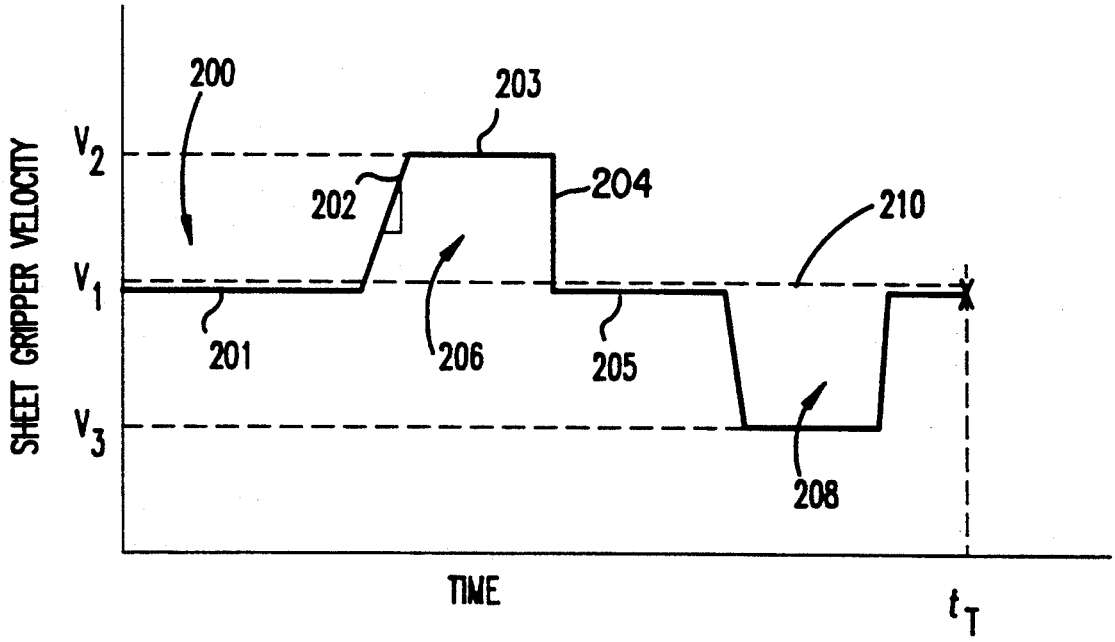
FIG. 9 shows the velocity profile imposed on the sheet gripper in accordance with the invention to prevent the sheet from touching the paper guide.

The desired velocity/time profile 200 of the sheet gripper is illustrated in FIG. 9. During portion 201 of the profile, the sheet gripper moves at its usual velocity $V_1$, which, in the illustrated example, is 190.5 mm/s. Portion 202 of the profile begins when the buckle dimension is to be reduced. In portion 202, the sheet gripper is accelerated from velocity $V_1$ to a higher velocity $V_2$, which may be, for example, 150% of velocity $V_1$, or, in the illustrated embodiment, 286 mm/s. Although the maximum rate of acceleration of the sheet gripper during portion 202, i.e., the slope of portion 202, is theoretically limited by the capacity of the servo motor 86, it is preferred to limit this acceleration to approximately 3 m/s$^2$. Higher accelerations can cause the body portion of the sheet to flutter. The flutter can propagate to the transfer zone, causing the sheet to partially detach from the photoreceptor belt 20 and thus disrupting the image.

After portion 202, the sheet gripper's velocity is maintained approximately constant at velocity $V_2$ during portion 203. It is then decelerated during portion 204 back to velocity $V_1$, where it remains during portion 205. The deceleration of the sheet gripper during portion 205 is not limited by sheet flutter considerations and therefore may be as large as desired or permitted by the servo motor.

The area 206 under the velocity/time profile, i.e. the integral of the profile under portions 202, 203, and 204 and above the usual velocity $V_1$, is the linear amount of buckle removed by the hitch. This amount can be adjusted, by adjusting the area 206, to any desired value. In the illustrated embodiment, this amount is approximately 6 mm. This suffices to reduce the extent of the buckle to an amount at which the long sheet 125 does not contact stationary surfaces. This reduced buckle is illustrated in FIG. 8 as 127'.

To maintain registration of successive images on the copy sheet, the sheet gripper must be decelerated for a sufficient time to so that it enters the transfer zone at a time $t_T$, which is the time it would reach the transfer zone if its velocity had been maintained constant at velocity $V_1$, indicated by a nominal profile 210. Since the sheet gripper was advanced from its nominal profile 210 by an amount equal to the area 206, it must be delayed by an equivalent amount before reaching the transfer zone. This is done by decelerating the gripper to a velocity $V_3$, which is lower than velocity $V_1$, moving it at that velocity for some time, then accelerating it back to velocity $V_1$. To preserve proper registration, the area 208 between this portion of the velocity/time profile 200 and the usual velocity $V_1$ must equal area 206. The rate of deceleration and subsequent acceleration are again limited by the servo motor's capacity or other design considerations rather than by the velocity transients imposed on the copy sheet.

Figure 10:
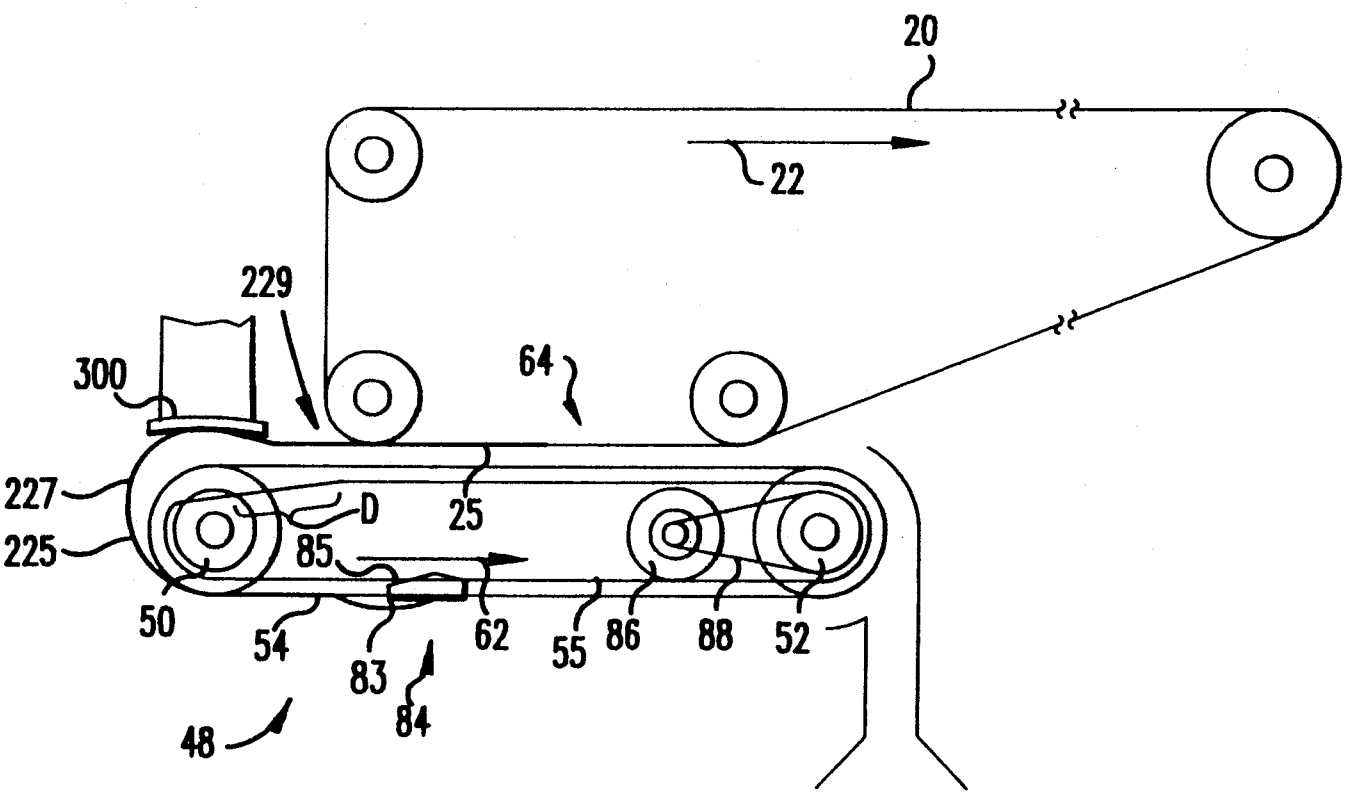
FIG. 10 is a schematic elevational view showing further details of the sheet transport system used in the electrophotographic printing machine of FIG. 1 and also showing the sheet gripper of the sheet transport system at a position where the trailing edge of a lightweight copy sheet has touches the paper guide.

Circulation of lightweight sheet stock in the illustrated color reprographic system can also lead to contact of the unfused toner image on the body portion of the copy sheet with stationary surfaces. As illustrated in FIG. 10, a lightweight, flexible sheet 225, such as a sheet having a weight less than approximately 15 pounds is susceptible to relatively large displacements from the desired path when the rear portion of the sheet is not controlled, such as when the trailing edge 229 of the sheet 225 disengages from the photoreceptor belt 20. The relatively low beam stiffness of the lightweight sheet is insufficient to resist the forces imposed by electrostatic attraction of the charged sheet to stationary objects, such as the cleaner guide 300, and by random air currents within the reprographic system.

The solution to this problem according to the present invention is to begin to accelerate the sheet gripper 84 when the trailing edge 229 is about to disengage the photoreceptor belt. The acceleration pulls the sheet toward the desired path and away from stationary surface that it might contact.

Figure 11:
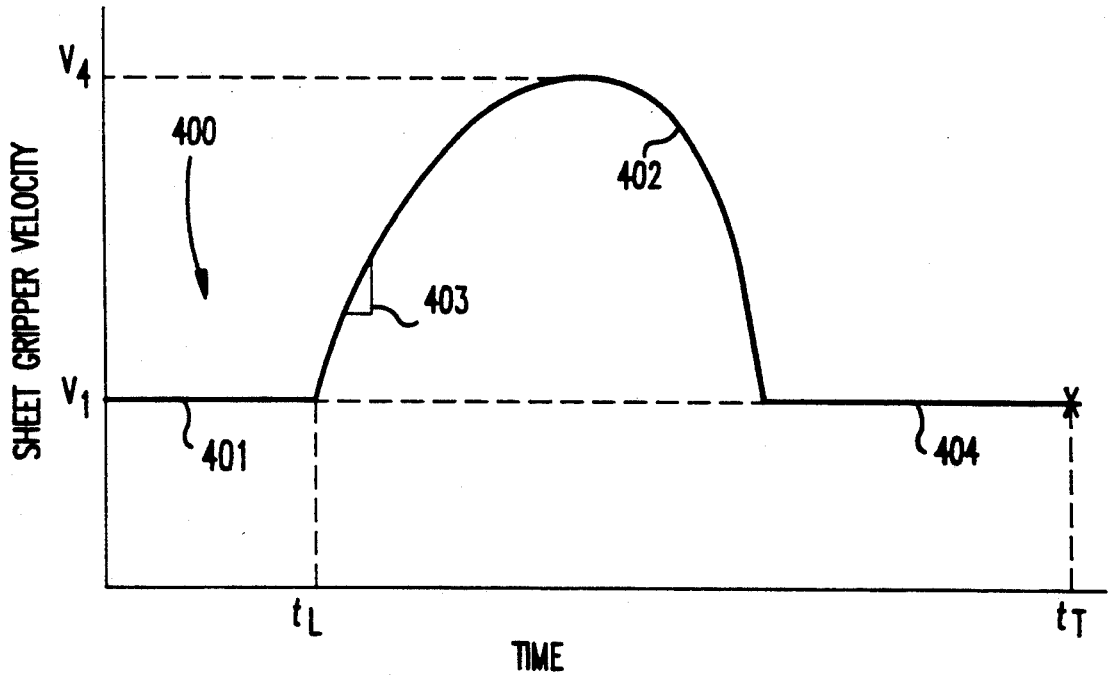
FIG. 11 shows the velocity/time profile imposed on the sheet gripper in accordance with the invention to prevent the trailing edge of the lightweight sheet from touching the paper guide.

The velocity profile 400 imposed on the sheet gripper is illustrated in FIG. 11. During portion 401, the sheet gripper moves at its usual velocity $V_1$. At time $t_L$, which is the time at which approximately 3 mm of the trailing edge of the copy sheet remains in contact with the photoreceptor belt, the sheet gripper enters portions 402, during which it is first accelerated, then decelerated, along a parabolic profile. The maximum acceleration 403 in the illustrated embodiment is approximately 8 m/s$^2$. The maximum deceleration is of approximately the same magnitude. Unlike the hitch to remove the excessive buckle in long sheets, this acceleration is not limited by rippling of the sheet since detachment of the last few milliliters of the sheet from the photoreceptor belt does not disrupt the tone image that is ultimately fused onto the copy sheet. The acceleration is therefore limited by the servo motor's capacity or by other considerations. The sheet gripper reaches a maximum velocity $V_4$, which in the illustrated embodiment is approximately 1 m/s. After portion 402, the sheet gripper enters portion 404 of the velocity/time profile 400, where it resumes its usual speed $V_1$. The sheet gripper is at velocity $V_1$ at time $t_T$ when it enters the transfer zone.

This velocity profile in general increases the throughput of the color reprographic system for smaller sheet sizes, such as 8½" by 11", by moving the sheet at high velocity over the interval between the trailing edge leaving the transfer zone and the sheet gripper entering the transfer zone for the next image. This mechanism for increasing throughput is described in U.S. Pat. No. 4,849,795, assigned to the assignee of the present application and the disclosure of which is incorporated herein by reference.

While the invention has been described with reference to a specific embodiment, it will be apparent to those skilled in the art that many alternatives, modifications, and variations may be made. Accordingly, it is intended to embrace all such alternatives, modifications that may fall within the spirit and scope of the appended claims.

What is claimed is:

1. An apparatus for advancing a sheet having a leading and a trailing edge through a transfer zone and into registration with information developed on a moving member, comprising:

a. means for advancing the sheet through the transfer zone at a first velocity;

b. means for creating a buckle in a portion of the sheet at the exit of the transfer zone, wherein the leading edge of the sheet is advanced at a second velocity that is less than said first velocity, while the trailing edge of the sheet is within the transfer zone; and c. means for selectively reducing said buckle, wherein the leading edge of the sheet is advanced at a third velocity that is greater than the second velocity, while the trailing edge of the sheet is within the transfer zone.

2. The apparatus of claim 1, further comprising:

a. a moving circuitous member, defining a continuous path, having a first portion adjacent the transfer zone and a second portion displaced from said transfer zone, b. a continuous track positioned substantially adjacent the path of said circuitous member; and c. a guide member engaging said track and gripping the sheet approximately at its leading edge.

3. The apparatus of claim 2, further comprising:

a. a second continuous track positioned substantially adjacent the path of said circuitous member; and b. a second guide member operatively connected to said first guide member and partially positioned within said second track.

4. A printing machine having a toner image developed on a moving member with a sheet having a leading and a trailing edge being advanced through a transfer zone and into registration with the toner image, comprising:

a. means for advancing the sheet through the transfer zone at a first velocity;

b. means, acting in unison with said advancing means, for creating a buckle in a portion of the sheet at the exit of the transfer zone, wherein the leading edge of the sheet is advanced at a second velocity that is less than said first velocity, while the trailing edge of the sheet is within the transfer zone; and c. means for selectively reducing said buckle, wherein the leading edge of the sheet is advanced at a third velocity that is greater than the second velocity, while the trailing edge of the sheet is within the transfer zone.

5. The printing machine of claim 4, further comprising:

a. a moving circuitous member defining a continuous path having a first portion adjacent the transfer zone and a second portion displaced from said transfer zone, b. a continuous track positioned substantially adjacent the path of said circuitous member; and c. a guide member engaging said track and gripping the sheet approximately at its leading edge.

6. An apparatus for advancing a sheet having a leading and a trailing edge through a transfer zone and into registration with information developed on a moving member, comprising:

a. means for advancing the sheet through the transfer zone at a first velocity;

b. means for advancing the leading edge of the sheet at a second velocity that is less than said first velocity at the exit of the transfer zone; and c. means for controlling the trailing edge of the sheet upon disengagement from the transfer zone, wherein the leading edge of the sheet is accelerated as the trailing edge disengages the transfer zone.

7. A method for controlling the movement of a sheet through a transfer zone and into registration with information developed on a moving member, comprising the steps of:

a. advancing the sheet through the transfer zone;

b. forming a buckle in the sheet at the exit of the transfer zone; and c. selectively reducing said buckle while a trailing portion of said sheet is in said transfer zone.

8. A method for advancing a sheet having a leading and a trailing edge through a transfer zone and into registration with information developed on a moving member, comprising the steps of:

a. advancing the sheet through the transfer zone at a first velocity;

b. creating a buckle in a portion of the sheet at the exit of the transfer zone, wherein the leading edge of the sheet is advanced at a second velocity that is less than said first velocity, while the trailing edge of the sheet is within the transfer zone; and c. reducing said buckle by selectively advancing the leading edge of the sheet at a third velocity that is greater than the second velocity, while the trailing edge of the sheet is within the transfer zone.

9. The method of claim 8, further comprising the step of:

accelerating the leading edge of the sheet as the trailing edge of the sheet disengages from the moving member.

* * * * *